United States Patent [19]

Moran

[11] Patent Number: 4,562,042

[45] Date of Patent: Dec. 31, 1985

[54] ANTICORROSIVE COMPOSITION

[75] Inventor: Francis Moran, Paris, France

[73] Assignee: Societe Anonyme dite: Union Chimique et Industrielle de l'Quest (U.C.I.O.-S.A.), Paris, France

[21] Appl. No.: 637,058

[22] Filed: Aug. 2, 1984

[30] Foreign Application Priority Data

Aug. 3, 1983 [EP] European Pat. Off. ..... 83401611.5

[51] Int. Cl.[4] ..... C23F 11/00; C09D 5/10

[52] U.S. Cl. ..... 422/13; 106/14.13; 106/14.15; 106/14.24; 252/390

[58] Field of Search ..... 422/13; 106/14.15, 14.13, 106/14.24; 252/390

[56] References Cited

U.S. PATENT DOCUMENTS

| | | | |
|---|---|---|---|
| 2,882,171 | 4/1959 | Denman | 106/14 |
| 2,956,889 | 10/1950 | Denman | 106/14 |
| 3,860,430 | 1/1975 | Walker et al. | 106/14 |
| 3,982,894 | 9/1976 | Annand et al. | 252/390 X |
| 4,084,971 | 4/1978 | Ginsberg | 106/14.44 X |
| 4,206,172 | 6/1980 | Sujdak | 422/9 |
| 4,276,089 | 6/1981 | Moran | 106/14.12 |

OTHER PUBLICATIONS

William L. Trace, Condensate Corrosion Inhibition—A Novel Approach; vol. 20 (1981).

*Primary Examiner*—Thurman K. Page

*Attorney, Agent, or Firm*—Holman & Stern

[57] ABSTRACT

This invention relates to a new anticorrosive composition for protecting metallic surfaces which are in contact with water as energetic or thermic corrosive fluid, in particular circuits, apparatus, devices or systems producing or using dry steam, wet steam, superheated water or hot water.

Said anticorrosive composition comprises (a) 1 to 100 parts by dry weight of an amine component selected from the group consisting of neutralizing amines and mixtures thereof, and (b) 1 part by dry weight of an amine component selected from the group consisting of film-forming polyamines of the formula $$R\text{-}[NH-(CH_2)_m]_n NH_2 \quad \text{(II)}$$

wherein R is a saturated or unsaturated hydrocarbon radical having from 12 to 22 carbon atoms, m is an integer between 2 to 8 inclusive and n is an integer between 1 to 7 inclusive; and mixtures thereof.

This invention is also concerned with a method for protecting the metallic surfaces of a system containing a generator of dry steam, wet steam, superheated water or hot water, which comprises administering said anticorrosive composition at the level of the deaerator-storage tank.

13 Claims, 2 Drawing Figures

ANTICORROSIVE COMPOSITION

DETAILED DISCLOSURE OF THE INVENTION

This invention relates to a new anticorrosive composition for inhibiting corrosion as a new industrial product, for protecting metallic surfaces of circuits, apparatus, devices and systems using water as energetic or thermic fluid, in particular with respect to $O_2$ and $CO_2$ dissolved, to $CO_2$ freed during water heating, and to $H_2CO_3$ formed during water condensation. It also related to a method of treatment for protecting said metallic surfaces by means of said anticorrosive composition.

The new corrosion inhibiting composition according to this invention is convenient for protecting systems using dry steam, wet steam, superheated water and hot water. It is useful in particular for circuits containing a generator of dry or wet steam, or a generator of superheated water.

The expression "superheated water" is meant to designate hereinafter a water stream which is liquid at a temperature higher than 100° C. under pressure. "Hot water" means here a water stream which is liquid at a temperature lower than 100° C. and generally higher than 50° C.

In the past, it is known that for solving the corrosion problem created by $CO_2$ and $H_2CO_3$ in systems containing a generator of steam or superheated water, two technical solutions have been proposed, namely (according to the prior art wording):

(1) the solution which consists in using one or several "neutralizing amines", and (2) the solution which consists in using one or several "film-forming amines".

The expressions "neutralizing amine" (in short NA) as well as "alkalizing amine" both designate hereinafter an amine which, at the level of the condensate receiver and in a general manner when the redissolving in liquid water of freed $CO_2$ takes place, gives a pH higher than 7, and preferably a pH higher than 8, to obviate the reaction drawback $CO_2+H_2O \rightarrow H_2CO_3$ which would lead, according to usual modi operandi, to a pH of 5–6 which is aggressive to metallic surfaces in particular those of iron, steel or copper.

Amongst the NA substances it is known that ammonia, hydrazine, morpholine, aniline, benzylamine and 2-amino-2-methyl-1-propanol which have already been used as corrosion inhibitors, require the use of an expensive and sometimes encumbering equipment, frequent dosages and control testings, and, in most cases, draining and blowing off operations which are relatively important with respect to steam or superheated water production. It is also known that NA substances can be aggressive or corrosive. For instrance $NH_3$ and $N_2H_4$ are known to be aggressive to copper and copper-containing alloys, in particular in the presence of oxygen. It is also known from the lecture entitled "Erosion-corrosion dans les turbines à vapeur humide" given by H. KELLER and A. W. SCHMITZ during the 117th session of the "Comité Technique de la Société Hydrotechnique de France" in Paris on Mar. 18–19, 1981, that morpholine exhibits several important drawbacks. In particular in order to have a pH value higher than 9.5, high concentrations are needed: about 100 mg of morpholine per 1 kg of steam produced.

The expressions "film-forming amine" or "filming amine" (in short FA) designate herein an aliphatic amine with a long hydrocarbon chain which, by deposit on inner surfaces of metallic systems in which circulates liquid water (for instance wet steam circuits, superheated water stream circuits, devices housed in said circuits—such as turbines, expanders—, condensate lines, and the like), forms a protecting film against aggressive means such as $O_2$ and $H_2CO_3$.

FA substances, in view of the generally used amounts, are slightly basic and cannot neutralize the acidity of $H_2CO_3$ unlike the NA ones. Moreover FA means differ from NA means by their higher molecular weight.

Amongst the FA substances previously known are included the fatty monoamines and fatty polyamines disclosed in FR-A-1 435 023, U.S. Pat. No. 2,857,333, U.S. Pat. No. 3,069,225, U.S. Pat. No. 3,523,894, NL-B-100 963, EP-A-10 485 and EP-A-65 609, and the hydroxyalkylamines disclosed in FR-A-2 310 420. These FA substances, which exhibit an anticorrosive effect at higher doses, increase corrosion at lower doses (see in particular page 2 lines 11–15 of EP-A-65 609); moreover, when associated with a dispersing agent or surfactant, they have the drawback of leading to an insufficient inhibition of aqueous corrosion. It has been found that FA substances, even associated with a tensioactive dispersing agent, do clog blowing off and draining devices.

Attempts to provide, as corrosion inhibitors against water, compositions containing a NA component and a FA component have failed up to now. For instance compositions containing (i) a neutralizing amine (such as cyclohexylamine, benzylamine, morpholine or diethylaminoethanol), (ii) a fatty monoamine (such as hydrogenated tallow amine, octadecylamine, laurylamine, or coconut amine) as film-forming amine, and (iii) optionally a dispersing agent (such as a polyoxyalkylene-containing amine), which were in particular disclosed in U.S. Pat. No. 3,860,430, U.S. Pat. No. 2,882,171, DE-B-1 288 402 and U.S. Pat. No. 2,956,889, were not satisfactory on an industrial scale as stated in a recent article by W. L. TRACE entitled "Condensate corrosion inhibition—A novel approach" published in Materials Performance 20 (No 5), pages 46–49 (May 1981) in view of their insufficient corrosion inhibiting effect in condensate systems.

According to this invention a new solution is provided to solve the technical problem of protecting against water corrosion metallic surfaces of circuits and systems using water as energetic or thermic fluid and comprising a generator of dry steam, wet steam, superheated water or hot water. The said new technical solution is based upon the use of a composition containing a NA component together with a special FA component from the group consisting of fatty polyamines.

Surprisingly it has been found that the association of a neutralizing amine with a fatty polyamine as filming amine allows the palliation of the above mentioned drawbacks, and presents a synergetic corrosion inhibiting effect with respect to the NA and FA components.

According to the invention a corrosion inhibiting composition is provided for protecting metallic surfaces of circuits, systems, apparatus and devices using water as energetic or thermic fluid for producing or using dry steam, wet steam, superheated water or hot water, said composition which contains a NA component and a FA component, being characterized in that it comprises (a) from 1 to 100 parts by dry weight of an amine component selected from the group consisting of neutralizing amines and mixtures thereof, and (b) 1 part by dry weight of an amine component selected from the group consisting of film-forming polyamines of the formula $$R\text{-}[NH-(CH_2)_m]_n-NH_2 \quad (II)$$

wherein R is a saturated or unsaturated hydrocarbon radical having from 12 to 22 carbon atoms, m is an integer comprised between 2 to 8 inclusive, and n is an integer comprised between 1 to 7 inclusive; and mixtures thereof.

For circuits and systems comprising a generator of dry or wet steam, or of superheated water, it is recommended to use an inhibiting composition wherein the NA component is stable up to a temperature of at least 250° C.

Are convenient, as NA substances in the composition according to this invention, the amines which are stable at a temperature which is higher than or equal to 250° C. and which give a pH higher than or equal to 8 at the condensate level, in particular for systems comprising a generator of steam or of superheated water, a water feeding tank (in French: "bâche alimentaire") which provides the generator with deaerated water, a portion of circuit in which the fluid coming from the generator is used, and a portion of circuit in which the condensate circulates or is received. For this purpose are particularly suitable compositions wherein the NA component is selected from the group consisting of ammonia, hydrazine, cyclopentylamine, cyclohexylamine, morpholine, aminoalcohol of the formula $$HO-A-NR'R'' \quad (I)$$

(wherein A is a $C_2$–$C_4$-alkylene group with a linear or branched hydrocarbon chain, R′ and R″, which may be identical or different, represent each a hydrogen atom or a $C_1$–$C_3$-alkyl group), aniline, benzylamine and mixtures thereof.

In the above formula I the preferred aminoalcohols are those wherein A is $-CH_2CH_2-$, $-CH(CH_3)CH_2-$, $-CH_2CH(CH_3)-$, $-C(CH_3)_2CH_2-$ and $-CH_2C(CH_3)_2-$. The most preferred aminoalcohols according to this invention are the 2-diethylamino-1-ethanol and 2-amino-2-methyl-1-propanol which in a non-diluted state are decomposed at a temperature starting from 300° C. and respectively 360° C. Cyclohexylamine and morpholine are also preferred NA substances which, in a non-diluted state, are decomposed at a temperature starting from 330° C. and respectively 340° C.

Amongst the FA substances the preferred ones, which are also the most easily accessible from an industrial point of view, are the polyamines of formula II wherein m is 3, and R is a $C_{12}$–$C_{22}$-hydrocarbon radical with a linear (preferably) or branched chain. Advantageously n is 1.

The amines of formula II may be used as found on the market, alone or mixed with one another, in their pure or technical forms. Polyamines prepared from fatty acids of animal, vegatable or synthetic origin may also be used. Among suitable polyamines on the market, particular mention may be made of the products known under the trade names DUOMEEN, DINORAM, TRINORAM, POLYRAM, LILAMIN and CEMULCAT which contain at least one polyamine according to formula II. Among the latter products, particular mentioned may be made of "DINORAM O" which contains approximately 75% by dry weight of oleylaminopropyleneamine, 9% of dry weight of stearylaminopropyleneamine and 6% by dry weight of hexadecylaminopropyleneamine, and "DINORAM S" which contains approximately 43% by dry weight of stearylaminopropyleneamine, 28% by dry weight of oleylaminopropyleneamine and 28% by dry weight of hexadecylaminopropyleneamine, these products being marketed by the firm CECA.

Figure 1:
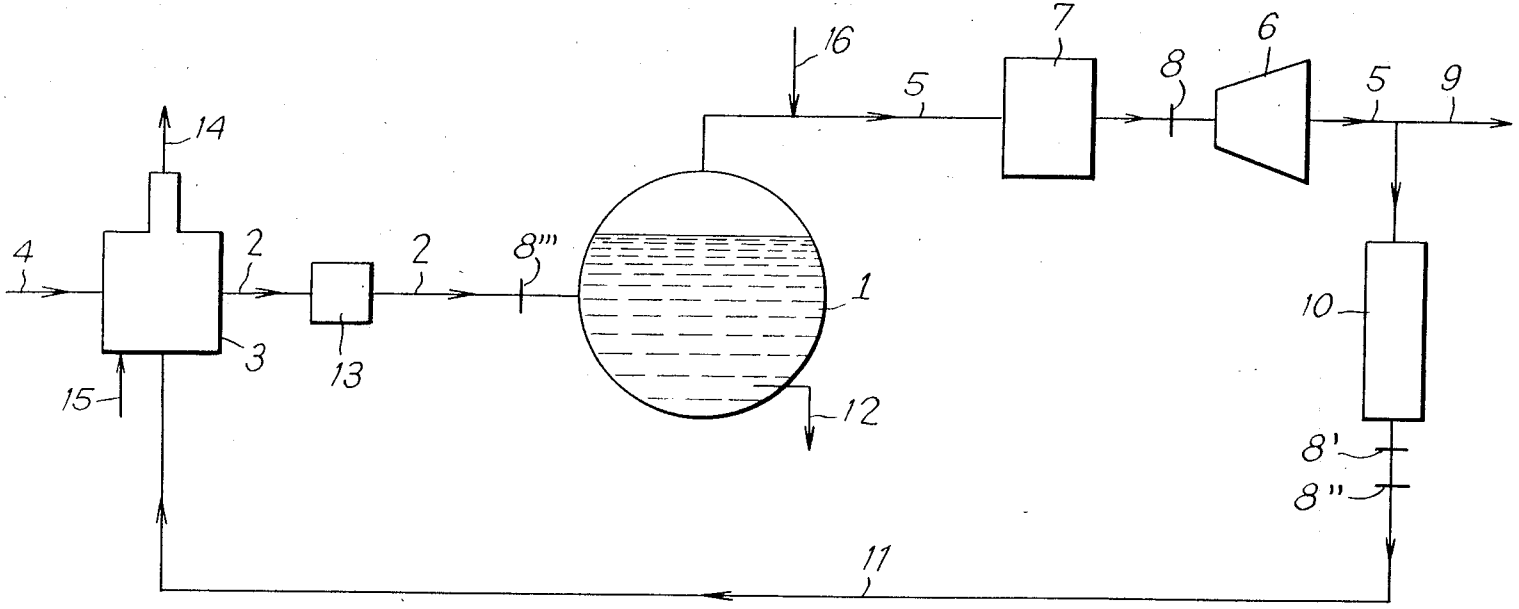
FIG. 1 and FIG. 2 represent schematically an industrial system fitting which is proposed to be protected according to the invention.

The interest of this invention will be better understood from the description of FIG. 1 which represents schematically an industrial system fitting which is proposed to be protected according to the invention.

That system comprises a generator 1 producing an energetic or thermic fluid (i.e. a generator of dry steam, wet steam or superheated water) which is here a boiler fitted with a blow-off or draining device 12, receiving feeding water 2 coming from feeding tank 3 (in French: bâche alimentaire) and producing an energetic or thermic fluid (here steam) which is used in circuit portion 5.

In generator 1 take place the following reactions:

$$2HCO_3^- \longrightarrow CO_3^{2-} + H_2O + CO_2\nearrow \text{, and}$$

$$CO_3^{2-} + H_2O \longrightarrow 2OH^- + CO_2\nearrow$$

from bicarbonate still present in the feeding water.

Feeding tank 3, which is supplied with topping water 4 (i.e. complement water), operates as deaerator (i.e. degassing unit) in order to eliminate the largest amount possible of dissolved $O_2$ and $CO_2$. The degassing operation is generally carried out by thermic route or by steam stripping route.

The portion of circuit in which circulates feeding water 2 advantageously comprises an economy device 13 wherein preheating of feeding water is performed, and, if necessary, one or several devices for controlling or measuring 8‴.

Circuit portion 5, in which the energetic or thermic fluid coming from generator 1 is used, can contain one or several turbines 6, one or several drying-superheating devices 7, one or several blow-off or draining devices (non-represented here), one or several devices for controlling or measuring 8, and, if necessary, a steam expanding devce.

Losses of energetic or thermic fluid are schematically represented in 9.

Circuit line 5 opens into condenser 10 which in a general manner operates as heat exchanger with another circuit (of water for instance) which is not represented here. Condensate line 11 reinjects the condensate into feeding tank 3 and may contain one or several devices for controlling or measuring 8′ and 8″.

According to the best method previously known, the NA substances were injected in 15 at the level of feeding tank 3, preferably the NA means was associated with $SO_3Na_2$ and $PO_4Na_3$, on the one hand, and the FA substances were injected in 16 near the exit of generator 1 in portion circuit line 5, preferably in aqueous suspension with a dispersing agent, on the other hand. Introduction of FA means into feeding tank 3 (contrary to the erroneous teaching of FR-A-1 435 023), into feeding water line 2, or into generator 1, does not exhibit any advantage with respect to the introduction of said means used alone in 16, and generally leads to corrosion inhibition rates which are lower than those resulting from said introduction in 16.

According to this invention it has been observed that the introduction of the composition, which comprises both NA and FA components, into 15 gives better results than (i) introduction of NA alone into 15, (ii) introduction of FA alone into 16, and (iii) introduction of said components at the same time NA into 15 and FA into 16.

Since FA substances are water insoluble, it is better to use a dispersing agent of the surfactant type. Advantageously, a composition is provided according to this invention which comprises (a) 1 to 100 parts by dry weight of component NA, (b) 1 part by dry weight of component FA, and (c) 0.01 to 0.5 part by dry weight of dispersing agent.

The preferred dispersing agent is selected from the group consisting of amines containing oxyalkylene groups, which result from the condensation reaction of monoamines and/or polyamines with alkylene oxides (in short AO) whereby 2 to 22 units of AO (mainly ethylene oxide or propylene oxide) are condensed per molecule of amine.

These amines which contain oxyalkylene groups are those which correspond to the general formula

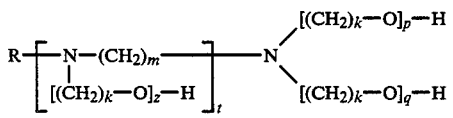

(III)

wherein R and m are as above-defined, k represents an integer of 2 or 3, p and q which can be identical or different represent each an integer comprised between 0 and 22 invlusive, t is an integer comprised between 0 and 7 inclusive, whereby the sum p+q+tz is an integer comprised between 2 and 22 inclusive.

The corrosion inhibiting composition is presented in the form of an aqueous suspension containing the NA and FA components and the dispersing agent. For carriage a concentrated aqueous suspension will be used. on the other hand for injection into 15 it is better to used a diluted aqueous suspension comprising from 10 to 15% by dry weight of the NA-FA-dispersing agent mixture, and from 90 to 75% by weight of water, advantageously said water having a resistivity (r) higher than or equal to $10^5$ Ω.cm, in particular deionized (or demineralized) water ($r>10^6$ Ω.cm or partially deionized ($r=10^5$ Ω.cm) in order to perform an introduction of 5–50 mg of NA-FA mixture per 1 l of topping water, and more preferably 10–20 mg/l of said NA-FA mixture.

In the best mode for carrying out the invention, the weight ratio NA-FA in said composition is comprised in the the range of from (2:1) to (8:1).

The corrosion inhibiting composition according to the invention is particularly suitable for protecting water systems in which circulate wet steam or superheated water, on the one hand, and condensate systems, on the other hand, of nuclear thermic plants producing electricity.

COMPARATIVE ASSAYS

Comparative assays which have been carried out on a pilot system according to FIG. 1, without the device 6 but containing means for introducing metallic samples in 8 and 8' and for measuring pH value in 8'' and 8''', in order to point out the interest and the synergetic effect of a composition according to this invention, have been summed up with their results hereinafter.

In these assays the very same components (NA: cyclohexylamine; FA: stearylaminopropyleneamine (for products B, A-1, A-2 and A-3) and stearylamine (for product C); dispersing agent: "NORAMOX S11") were used with the very same amounts, namely:

Product B (according to the invention) injected in 15 in order to have, for 1 liter of topping water, 10 mg of NA, 10 mg of FA and 1 mg of dispersing agent;

Product A-1 (conventional prior treatment) comprising NA, $Na_2SO_3$ and $Na_3PO_4$ introduced in 15 in order to have 10 mg of NA per 1 liter of topping water, 20 mg/l of $PO_4^{3-}$ in the water of boiler 1 and 30 mg/l of $SO_3$ in the water of boiler 1 (concerning the excess of $SO_3$ with respect to $O_2$);

Product A-2 (conventional prior treatment) constituted by an aqueous suspension containing 10 parts by dry weight of FA and 1 part by dry weight of dispersing agent, introduced in 16 in order to have 10 mg of FA for 1 kg of steam and 1 mg of dispersing agent for 1 kg of steam;

Product A-3 constituted by NA introduced in 15 at a dosage of 10 mg of NA per 1 liter of topping water, and by product A-2 introduced in 16 as indicated above; and, Product C (according to the teaching of U.S. Pat. No. 3,860,430) consisting in an aqueous suspension of NA, FA and dispersing agent wherein FA is a fatty monoamine (stearylamine), introduced in 15 in order to have, as for product B, 10 mg of NA, 10 mg of FA and 1 mg of dispersing agent per 1 liter of topping water.

Topping water introduced into the pilot system according to FIG. 1, was a partially deionized water (resistivity of about $10^5$ Ω.cm), generator 1 delivering steam at a pressure of $3.5\times10^6$ Pa (i.e. 35 bars), and the maximum temperature which was of 320° C. being obtained in device 7.

The results obtained (average of 5 assays per product to be tested) are given in table I below, and clearly show the interest of the composition according to the invention with respect to the prior known techniques: product B according to this invention gives (i) a pH value higher than those of A-1, A-2 and A-3 in feeding water and in condensate and (ii) corrosion speeds in μm/year particularly lower than those of A-1, A-2, A-3 and C in dry steam portion vis-à-vis steel, on one hand, and in condensate portion vis-à-vis steel and copper, on the other hand.

TABLE I

COMPARATIVE ASSAYS ON PILOT SYSTEM

| | | | corrosion speed (μm/year) | | |
|---|---|---|---|---|---|
| | pH | pH | dry steam | condensate | |
| Product | feeding water | condensate | steel | steel | copper |
| A-1 (a) | 7.1 | 8.0 | 150 | 250 | 50 |
| A-2 (a) | 5.8 | 7.5 | 115 | 195 | 25 |
| A-3 (a) | 7.5 | 8.3 | 20 | 60 | 8 |
| B (b) | 8.5 | 9.0 | 4 | 15 | 2 |

TABLE I-continued

| COMPARATIVE ASSAYS ON PILOT SYSTEM | | | | | |
|---|---|---|---|---|---|
| | | | corrosion speed (μm/year) | | |
| | pH | pH | dry steam | condensate | |
| Product | feeding water | condensate | steel | steel | copper |
| C (a) (c) | 8.0 | 8.6 | 35 | 70 | 10 |

Notes
(a) prior technique
(b) according to this invention
(c) according to the teaching of US-A-3 860 430

Figure 2:
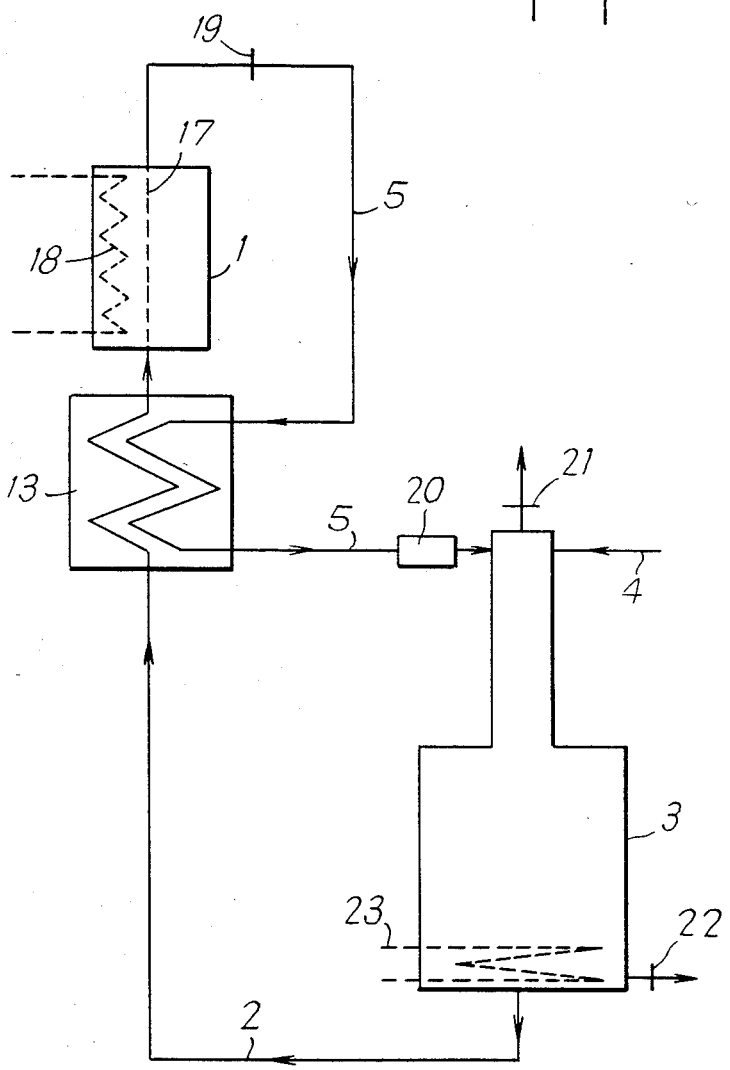

Further assays have been carried out on a laboratory system (of the SCHIKORR type) analogous to the system of FIG. 1 and schematized as represented in FIG. 2.

As indicated in FIG. 2, the laboratory system is composed in particular of:

a generator 1 the active portion of which is a test tube 17 heated by an electric heating element 18, and which is fed with feeding water 2 preheated in preheater 13, a circuit portion 5 in which circulates the thermic fluid produced by generator 1, which is equipped with measuring device 19 (manometer, etc. . . . ), which allows to preheat the feeding water in 13 and which contains a steam expander schematically represented in 20 before entering feeding water tank, a feeding water tank 3 useful as condenser and degassing unit equipped at its bottom part with an electric heating element 23 (for thermic degassing) and with a device 22 for taking water samples (in particular for measuring pH and resistivity of said water samples), and also equipped at its top part with a device 21 for collecting volatile uncondensable substances, an arrival of topping water 4 issuing into the top part of feeding water tank 3, and a circuit portion 2 in which circulates feeding water and which comprises a pump (non-represented here).

With such a laboratory system, when test tube 17 is made of steel, the influence of aqueous corrosion is measured by determining the amount or volume of hydrogen collected in 21 and resulting from the following reaction:

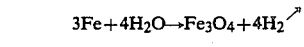

$$3Fe+4H_2O \rightarrow Fe_3O_4+4H_2\nearrow$$

For this purpose measures were performed at "stabilisation", that is to say 28 hours after the beginning of assays (i) without corrosion inhibitor, (ii) with $NH_3$ as corrosion inhibitor introduced in topping water 4 at a dose of 15 mg/l, and (iii) with corrosion inhibiting composition of example 3 (introduced into topping water at dosages of 5 mg/l of stearylaminopropyleneamine and 10 mg/l of 2-amino-2-methyl-1-propanol), in order to obtain a pH value of 9.2 (measured in 22) when a corrosion inhibitor is used.

With the following experimental conditions:

test tube: common steel (A 42)

applied power: 1,950 watts energetic flux: 400,000 kilocalories/h/m$^2$ (i.e. about 465 kilowatts/m$^2$)

quality of water: deionized water with a resistivity higher than $10^6\Omega$.cm water highest temperature (in generator): 305° C.

pressure (in 19): $10^7$ Pa richness of the water-steam emulsion: 24% the following quantity of $H_2$ was obtained, at stabilisation, in 21:

without inhibitor . . . 50 vpm (volumes per million) of $H_2$ with $NH_3$ . . . 10 vpm of $H_2$ with composition of example 3 . . . 0.5 vpm of $H_2$ According to this invention a method is provided for protecting metallic surfaces of a system using water as thermic or energetic fluid, and containing a generator of dry or wet steam, a generator of superheated water or a generator of hot water, by means of a corrosion inhibiting composition as disclosed hereinabove. Said method is characterized in that said corrosion inhibiting composition is administered into said system at the level of the feeding water tank (preferably with topping water) in an amount of from 5 to 50 mg (preferably from 10 to 20 mg) of the mixture of NA and FA components per 1 liter of topping water.

As indicated hereinabove an anticorrosive composition will be advantageously used, which contains 10–25% by dry weight of the NA-FA-dispersing agent mixture and 90–75% by weight of water having a resistivity higher than or equal to $10^5$ Ω.cm.

Other advantages and characteristic features of this invention will be better understood after reading the following description in no way limitative of examples of inhibiting composition according to this invention.

EXAMPLE 1

A corrosion inhibiting composition is prepared according to the following formulation:

Cyclohexylamine . . . 8% by weight

Oleylaminopropyleneamine . . . 4% by weight

Dispersing agent [oxyethyleneated amine of formula III obtained by condensation with 11 molecules of ethylene oxide (k=2; p+q+tz=11), commercialized under the trademark of "NORAMOX S 11"] . . . 1% by weight Partially deionized water (resistivity of $10^5$ Ω.cm) . . . 87% by weight This aqueous composition is advantageously suitable in systems containing a generator of dry steam.

EXAMPLE 2

A corrosion inhibiting composition is prepared according to the following formulation wherein the NA component is a mixture of two neutralizing amines (cyclohexylamine and 2-amino-2-methyl-1-propanol):

Cyclohexylamine . . . 4.5% by weight

2-Amino-2-methyl-1-propanol . . . 15% by weight

Oleylaminopropyleneamine . . . 3% by weight

Dispersing agent (the one of example 1) 0.25% by weight

Deionized water (resistivity higher than $10^6$ Ω.cm) . . . 77.25% by weight

This aqueous composition is advantageously suitable in systems containing a generator of wet steam or of superheated water.

EXAMPLE 3

A corrosion inhibiting composition is prepared according to the following formulation:

2-Amino-2-methyl-1-propanol . . . 5% by weight

Stearylaminopropyleneamine . . . 10% by weight

Dispersing agent (the one of example 1) . . . 0.75% by weight

Deionized water (resistivity higher than $10^6$ Ω.cm) . . . 84.25% by weight

This aqueous composition is advantageously suitable in systems containing a generator of wet steam or of superheated water.

EXAMPLE 4

A corrosion inhibiting composition is prepared according to the following formulation:

Cyclohexylamine . . . 8% by weight

Mixture comprising 75 parts by dry weight of oleylaminopropyleneamine, 9 parts by dry weight of stearylaminopropyleneamine and 6 parts by dry weight of hexadecylaminopropyleneamine (commercialized under the trademark of DINORAM O) . . . 4% by weight Dispersing agent (the one of example 1) . . . 1% by weight Partially deionized water (resistivity of $10^5$ Ω.cm) . . . 87% by weight This composition is advantageously suitable in systems containing a generator of dry steam.

EXAMPLE 5

A corrosion inhibiting composition is prepared according to the following formulation:

Cyclohexylamine . . . 10% by weight

2-Diethylamino-1-ethanol . . . 3% by weight

Mixture comprising 43 parts by dry weight of stearylaminopropyleneamine, 28 parts by dry weight of oleylaminopropyleneamine and 28 parts by dry weight of hexadecylaminopropyleneamine (commercialized under the trademark of DINORAM S) . . . 5% by weight Dispersing agent (the one of example 1) . . . 1% by weight Partially deionized water (resistivity of $10^5$ Ω.cm) . . . 81% by weight

EXAMPLE 6

A corrosion inhibiting composition is prepared according to the following formulation wherein the NA component is a mixture of two neutralizing amines and the FA component is also a mixture of several fatty polyamines of formula II:

Cyclohexylamine . . . 4.5% by weight

2-Amino-2-methyl-1-propanol . . . 15% by weight

Mixture comprising 75 parts by dry weight of oleylaminopropyleneamine, 9 parts by dry weight of stearylaminopropyleneamine and 6 parts by dry weight of hexadecylaminopropyleneamine (commercialized under the trademark of DINORAM O) . . . 3% by weight Dispersing agent (the one of example 1) . . . 0.25% by weight Deionized water (resistivity higher than $10^6$ Ω.cm) . . . 77.25% by weight This composition is advantageously suitable in systems containing a generator of dry steam, wet steam or superheated water.

What is claimed is:

1. A corrosion inhibiting composition for protecting metallic surfaces of circuits or systems using water as energetic or thermic fluid, and containing a generator of dry steam, wet steam, superheated water or hot water, said composition which contains a neutralizing amine component and a film-forming amine component comprising (a) from 1 to 100 parts by dry weight of an amine component selected from the group consisting of neutralizing amines and mixtures thereof, and (b) 1 part by dry weight of an amine component selected from the group consisting of film-forming polyamines of the formula $$R\text{-}[NH-(CH_2)_m]_n-NH_2 \qquad \text{(II)}$$

wherein, R is a saturated or unsaturated hydrocarbon radical having from 12 to 22 carbon atoms, m is an integer between 2 to 8 inclusive, and n is an integer between 1 to 7 inclusive; and mixtures thereof.

2. A corrosion inhibiting composition according to claim 1 wherein the neutralizing amine component is selected from the group consisting of ammonia, hydrazine, cyclopentylamine, cyclohexylamine, morpholine, aminoalcohol of the formula $$HO-A-NR'R'' \qquad \text{(I)}$$

(wherein A is a $C_2$–$C_4$-alkylene group with a linear or branched hydrocarbon chain, R' and R'', which may be identical or different, represent each a hydrogen atom or a $C_1$–$C_3$-alkyl group), aniline, benzylamine and mixtures thereof.

3. A corrosion inhibiting composition according to claim 1 wherein the neutralizing amine component is selected from the group consisting of cyclohexylamine, morpholine, 2-diethylamino-1-ethanol, 2-amino-2-methyl-1-propanol and mixtures thereof.

4. A corrosion inhibiting composition according to claim 1 wherein the film-forming amine component is a polyamine of the formula II wherein m is 3.

5. A corrosion inhibiting composition according to claim 1 wherein the film-forming amine component is a polyamine of the formula II wherein m is 3 and n is 1.

6. A corrosion inhibiting composition according to claim 1 comprising (a) from 1 to 100 parts by dry weight of a neutralizing amine component, (b) 1 part by dry weight of a film-forming amine component, and (c) from 0.01 to 0.5 part by dry weight of a dispersing agent.

7. A corrosion inhibiting composition according to claim 6 wherein the dispersing agent is selected from the group consisting of oxyalkylene-conntaining amines of the formula

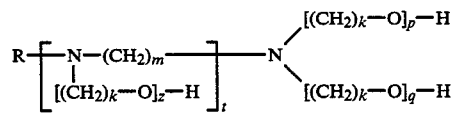

(III)

wherein R and m are defined as indicated above in claim 1, k represents an integer of 2 or 3, p and q, which can be identical or different, represent each an integer between 0 and 22 inclusive, t represents an integer between 0 and 7 inclusive, whereby the sum p+q+tz is an integer comprised between 2 and 22 inclusive.

8. A corrosion inhibiting composition according to claim 1 wherein the weight ratio of the neutralizing amine component to the film-forming amine component is comprised between (2:1) and (8:1).

9. A corrosion inhibiting composition according to claim 1 comprising from 10 to 25% by dry weight of a mixture of neutralizing amine component, film-forming polyamine component and dispersing agent, and from 90 to 75% by weight of water.

10. A corrosion inhibiting composition according to claim 9 wherein water has a resistivity higher than or equal to $10^5$ Ω.cm.

11. A method for protecting metallic surfaces of a system containing a generator of dry steam, wet steam or superheated water, a feeding water tank providing said generator with feeding water, a circuit portion in which circulates or is stored the condensate, by means of a corrosion inhibiting composition according to claim 1, said method comprising administering at the level of the feeding water tank from 5 to 50 mg of the mixture of the neutralizing amine component and the film-forming polyamine component per 1 liter of topping water introduced into said system.

12. A method according to claim 11 wherein a corrosion inhibiting composition comprising (i) from 10 to 25% by dry weight of a mixture of neutralizing amine component, film-forming polyamine component and dispersing agent, and (ii) from 90 to 75% by weight of water having a resistivity higher than or equal to $10^5$ Ω.cm, is administered at the level of the feeding water tank.

13. A method according to claim 11 wherein 10 to 20 mg of the mixture of the neutralizing amine component and the film-forming polyamine component are introduced at the level of the feeding water tank per 1 liter of topping water.

* * * * *